United States Patent [19]

Wallace

[11] 4,084,794

[45] Apr. 18, 1978

[54] HOIST OR WINCH MECHANISM ADAPTED FOR MULTIPLE VARIABLE RIGGING

[75] Inventor: Bernard E. Wallace, Exton, Pa.

[73] Assignee: B. E. Wallace Products Corporation, Malvern, Pa.

[21] Appl. No.: 703,830

[22] Filed: Jul. 9, 1976

[51] Int. Cl.[2] ..... B66D 3/08

[52] U.S. Cl. ..... 254/189; 254/167

[58] Field of Search ..... 254/188, 165, 167, 189, 254/139, 164, 169

[56] References Cited

U.S. PATENT DOCUMENTS

| | | | |
|---|---|---|---|
| 1,436,608 | 11/1922 | Rodier | 254/188 |
| 1,971,511 | 8/1934 | Stahl | 254/188 |
| 2,200,896 | 5/1940 | Rio | 254/188 X |
| 2,351,665 | 6/1944 | Coffing | 254/188 |
| 3,215,404 | 11/1965 | Ryan | 254/188 |
| 3,741,528 | 6/1973 | Profet | 254/167 |

FOREIGN PATENT DOCUMENTS

| | | | |
|---|---|---|---|
| 1,084,005 | 9/1967 | United Kingdom | 254/188 |

*Primary Examiner*—Drayton E. Hoffman

*Assistant Examiner*—Donald W. Underwood

*Attorney, Agent, or Firm*—Raymond H. Synnestvedt

[57] ABSTRACT

Portable hoist or winch apparatus comprises such mechanism having a frame carrying a drum for a cable or other flexible member, and load-carrying means which includes first and second pulley block assemblies. A hook-bearing first assembly, in normal use, depends from a loop of cable extending from the drum back into securement with the winch frame; a second assembly is disposed in the cable rigging intermediate the drum and the first assembly. The first pulley block assembly has at least two pulleys; the second pulley block assembly has at least one pulley. The cable extends serially from the drum to a pulley of the first assembly, thence to the pulley of the second, back to the second pulley of the first assembly, and thence to the frame. Movement of the second assembly between a position in which it is coupled to the first assembly, and a position in which it is coupled to the winch frame, converts the rigging so that the ideal mechanical advantage of the apparatus is varied from a predetermined value to a value which is a multiple thereof.

1 Claim, 6 Drawing Figures

FIG. 1.
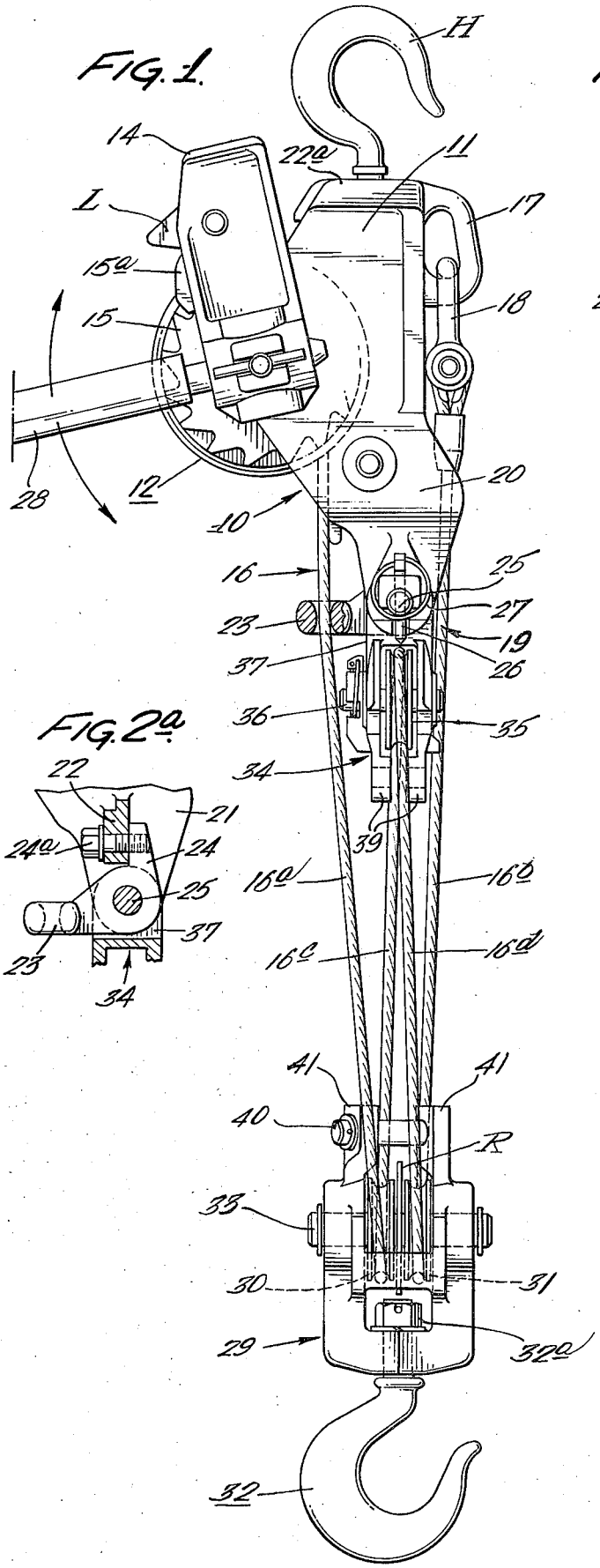
FIG. 2a
FIG. 2.
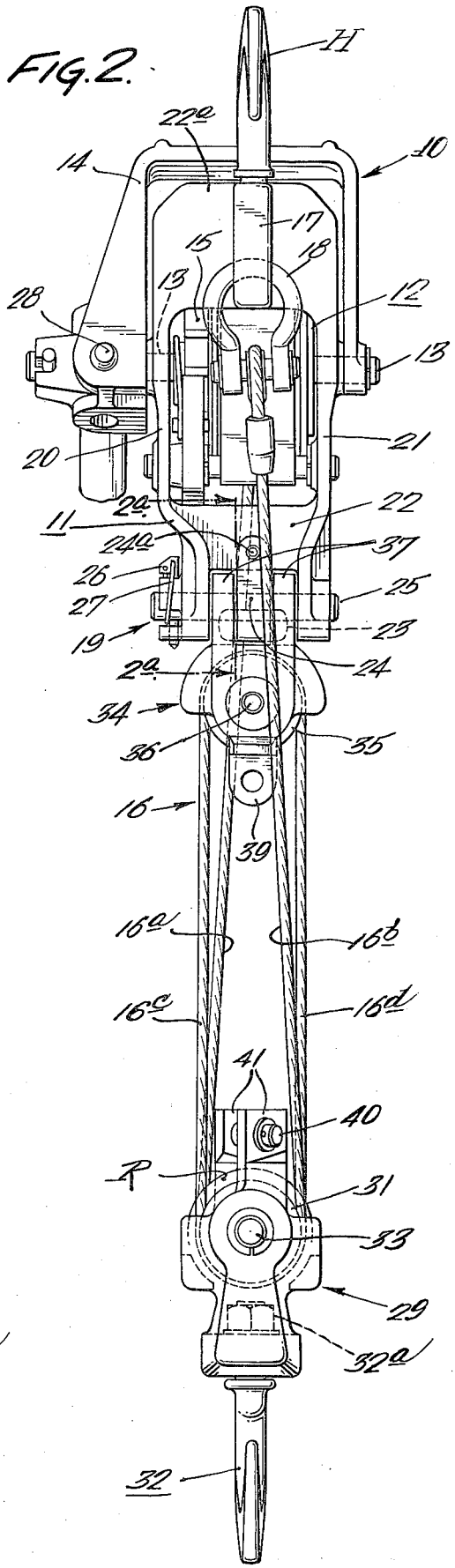

HOIST OR WINCH MECHANISM ADAPTED FOR MULTIPLE VARIABLE RIGGING

BACKGROUND OF THE INVENTION

My invention relates to a pulling mechanism, such as a winch-hoist, and typically, in a preferred form, to portable, hand operated winch-hoists in which a main frame is hooked, or otherwise coupled, to fixed structure and has a rotatable winding drum and a loop of cable which has end portions fixed to the drum and to the frame, means being provided for actuating the drum to reel in the cable and to permit and to control unreeling thereof. The cable extends toward the load, in most instances hanging from the drum in the frame, and terminates in load-carrying means, or extends to and through a hook-bearing pulley block, then returning to and terminating at the main frame. An operating lever is pivoted to the main frame for swinging movements about the drum axis, and ratchet and pawl mechanism is operable to rotate and control the drum and cable when the lever is actuated.

For the purposes of the present invention, the general type of apparatus to which my invention can be applied may be of one or more known types, such, for instance, as the type of apparatus shown and described in my copending Application Ser. No. 629,262, filed Nov. 6, 1975, now U.S. Pat. No. 4,003,551 Application being a continuation of my Application Ser. No. 453,919 filed Mar. 22, 1974, now abandoned. For example, in carrying out the purposes of the present invention, certain features, such as the pawl and ratchet mechanism employed in the apparatus of said copending application may be used. Similar elements are also shown and described in U.S. Pat. No. 2,633,328, issued Mar. 31, 1952.

While apparatus of such type has proven to be highly advantageous, it still leaves something to be desired relative to the range of loads which can be handled with ease and convenience, as such apparatus generally has one load rating, sometimes supplemented by double rating, with capacity limitations imposed by the effort required to operate a handle of practical length.

SUMMARY OF THE INVENTION

It is the general objective of my invention to provide improved winch-hoist apparatus, especially in the field above-mentioned. Specifically, it is an object to provide apparatus which is readily convertible by making an extremely simple adjustment, from a double rigged condition to a condition which is a multiple thereof or to a single rigged condition.

In the particular embodiment illustrated, the apparatus may be operated under either a double rigged condition or under a condition of quadruple rigging; that is, it is possible to increase the mechanical advantage (ignoring friction) from a value of 2 to a value of 4. For example, by utilization of the invention, a hoist which would previously have been rated at 1500 pounds, single-rigged, may be operated, under quadruple rigging, to raise about 6000 pounds. In using such terms as "winch-hoist" or "hoist", "raise" and "lower", "load-carrying", and the like, it should be understood that the apparatus of the present invention is not limited to lifting and lowering of a load, but rather is intended to be of general adaptability where pulling forces must be exerted; and therefore such terms, and similar terms, are not used herein by way of limitation but rather by way of illustration.

The improved apparatus is featured by making it possible to achieve such substantial increases in load-carrying capacity with disproportionately lower increases in weight of the equipment, and in required handle effort. In addition, my new apparatus, since it can provide relatively high mechanical advantage, requires a shorter operating handle than would normally be required for comparable capacity. Thus it can be used with greater convenience in closer quarters.

These advantages are achieved with an increase in operator safety, and with lighter, and therefore more economical, construction. The invention also makes possible a multiple convertability of capacity, for chain hoists as well as on cable hoists.

To the foregoing general ends the invention provides, in addition to the usual pulley-carrying block assembly which supports the load, a second pulley block assembly interposed in the rigging between the usual assembly and the winch frame, with the cable extending serially from the winch drum to the first or lower pulley assembly, thence to the second or intermediate assembly, then back again to the first assembly, and thereafter returning to and into securement with the frame. Means is provided to secure the second assembly either to the first assembly, when doubled rigging is desired, or to said winch frame, when quadrupled rigging is desired.

Although the apparatus of the invention is shown as having a capability for either double or quadruple rigging, the second of which provides a doubling of the mechanical advantage, it will be appreciated that, in its broader aspect, the invention is equally applicable to apparatus in which the construction, and the adjustment of the position of the second pulley block assembly, may be arranged to provide for converting the apparatus from a rigging having a first predetermined mechanical advantage to a rigging having a second mechanical advantage greater than double the first. The gain in mechanical advantage is controlled by choice of the number of pulleys provided in the first and second block assemblies, that is, by the rigging.

It is also a feature of my invention that the apparatus is so constructed as to maintain optimum alignment between the cable and the pulleys of the first and second pulley block assemblies.

BRIEF DESCRIPTION OF THE DRAWINGS

In the accompanying drawings

FIG. 1 is a side elevational view of a portable winch-type hoist embodying the present invention, the view illustrating the hoist under a condition of quadruple rigging;

FIG. 2 is an end elevational view of the apparatus shown in FIG. 1;

FIG. 2*a* is a fragmentary section on the line 2*a*-2*a* of FIG. 2;

DETAILED DESCRIPTION OF THE PREFERRED EMBODIMENT

Figure 3:
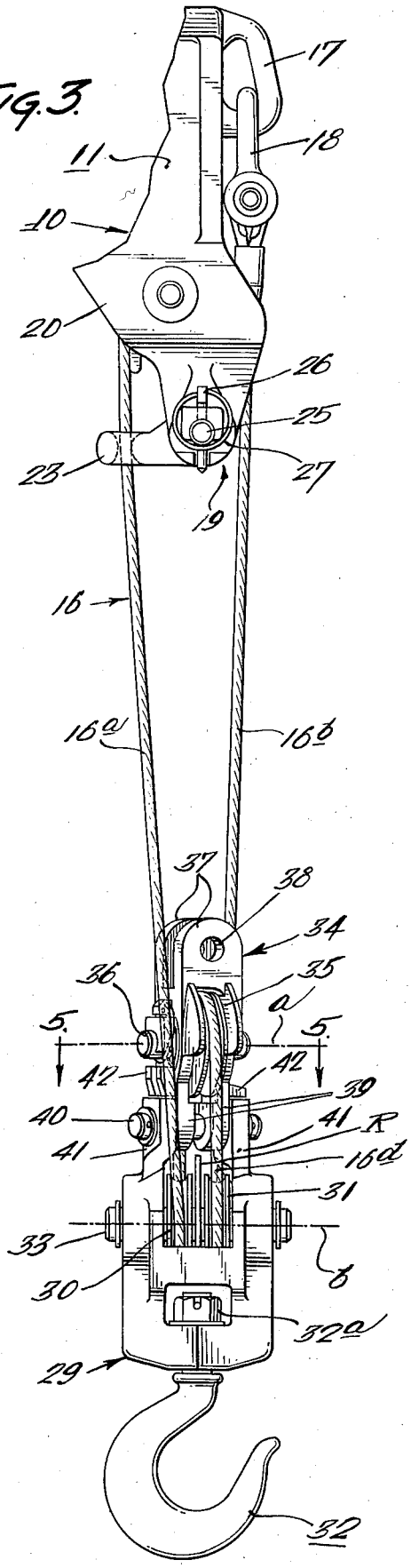
FIG. 3 is a fragmentary, side elevational, view showing the apparatus under a double rigged condition.

With initial reference to FIGS. 1, 2 and 3, there is shown hoist apparatus comprising an upper winch assembly 10, comprising a main frame 11, and a drum 12, rotatably mounted on said main frame through the agency of an axle 13 (FIG. 2).

In accordance with the disclosure of said copending application, and of the identified patent, lever means 14 is also pivoted on said axle for swinging movements about the rotational axis of the drum 12, and ratchet means 15 cooperates with pawl means, a portion of which appears at 15*a*, to rotate said drum for reeling of cable 16 thereon and, alternatively, for controlled opposite rotation of the drum, after manipulation of a cocking lever L, for unreeling of the cable from the drum, under the pull of the load.

Detailed description of the winch assembly 10 is not required in this disclosure, although it should be noted that the outboard end of the cable 16 is secured to an anchor means, such as a loop 17 provided at the upper end portion of the main frame 11, through the agency of a shackle or the like 18, and that the winch frame carries attachment means 19 through the agency of which the adjustable pulley block, described below, may be secured to the winch frame when multiple (in the illustrated case, quadruple) rigging is desired. This attachment means is described in detail below and, for present purposes, it is sufficient to point out that the illustrated winch frame 11 is of generally box shape, having a pair of spaced vertical walls or arms 20 and 21, and a bottom cross brace 22 (FIG. 2) and top cross-structure 22a (FIGS. 1 and 2).

The attachment means 19 forms part of cable guide means comprising a guide loop, which is part of a structure of bell-crank form, comprising the apertured arm 23 and the vertical arm 24. In accordance with the disclosure of said copending application, the said member or structure 23,24 (FIG. 2) is mounted between the frame arms 20 and 21 by an axle or pivot pin 25 retained within the arms by a securing pin 26 (FIGS. 1 and 2) and a looped spring 27. Such pin and loop devices are well known, the pin being insertable within a cross-aperture provided in pivot pin 25, after which, swinging of the loop resiliently engages the same with a boss forming part of the winch frame structure. Fixation of the position of the cable guide may be accomplished by a stud, or the like, 24*a*, shown in FIG. 2*a*.

As will now be understood, and as is described in detail in my said copending application, driving of the drum 12, when it is desired to reel cable on said drum, or to unreel the cable, is accomplished in response to swinging movements of the lever 14 through the agency of a handle 28 which may be associated with the lever 14 in any of four different positions, all in accordance with the teaching of the copending application. It will be understood, of course, that an anchor hook, shown at H, is secured in the top cross structure 22*a* of the frame 11 and is usually employed to support the winch from fixed structure. The securement of this hook H may be similar to that of hook 32 below-described.

As appears to good advantage from comparison of FIGS. 1 and 3, the apparatus may be converted from a double rigged condition (FIG. 3) to a rigging which is a multiple thereof, such as the quadruple rigging appearing in FIGS. 1 and 2. With reference to FIG. 3, the cable 16 has a looped intermediate portion comprising a left hand run of cable 16*a* and a right hand run 16*b*. The loop of cable formed by these runs 16*a* and 16*b* carries a first, lower, load-carrying, pulley block assembly 29 provided with a pair of pulleys 30 and 31 and a load-carrying hook 32 having its shank secured by nut 32*a*. The pulley block is bifurcated to receive the pulleys which are held therein through the agency of an axle pin 33. Pulley and cable guard means obscures the pulleys somewhat in FIGS. 1 and 3, but they appear to good advantage in FIG. 4. Their central spacing ring R appears in FIG. 1 to 4.

In particular accordance with the present invention, a second pulley block assembly 34 is disposed in a loop of the cable rigging between the first or main pulley block 29, and the upper winch assembly 10. In the embodiment illustrated, this block assembly has a single pulley 35 which is carried by an axle 36 which journals the pulley in the bifurcated frame of block 34. This block has upper as well as lower bifurcations, and the upper bifurcations are comprised of arms 37,37, each of which is apertured as at 38 (see particularly FIG. 4), and they are employed in the manner described hereinafter.

The lower bifurcated portion of pulley-block assembly 34 is comprised of arms 39,39, which are apertured to accommodate a pin 40. This pin, under the double rigged condition shown in FIGS. 3 and 4, secures the second pulley block assembly to the first or main pulley block 29. Pulley block 29 is also provided with a pair of arms 41,41, each of which is twisted somewhat with respect to the block 29, for a purpose to be described below; and pin 40, under the double rigged condition shown in FIGS. 3 and 4, secures the arms 39,39, to the arms 41,41, of lower pulley block 29, which arms straddle said arms 39,39.

Figure 4:
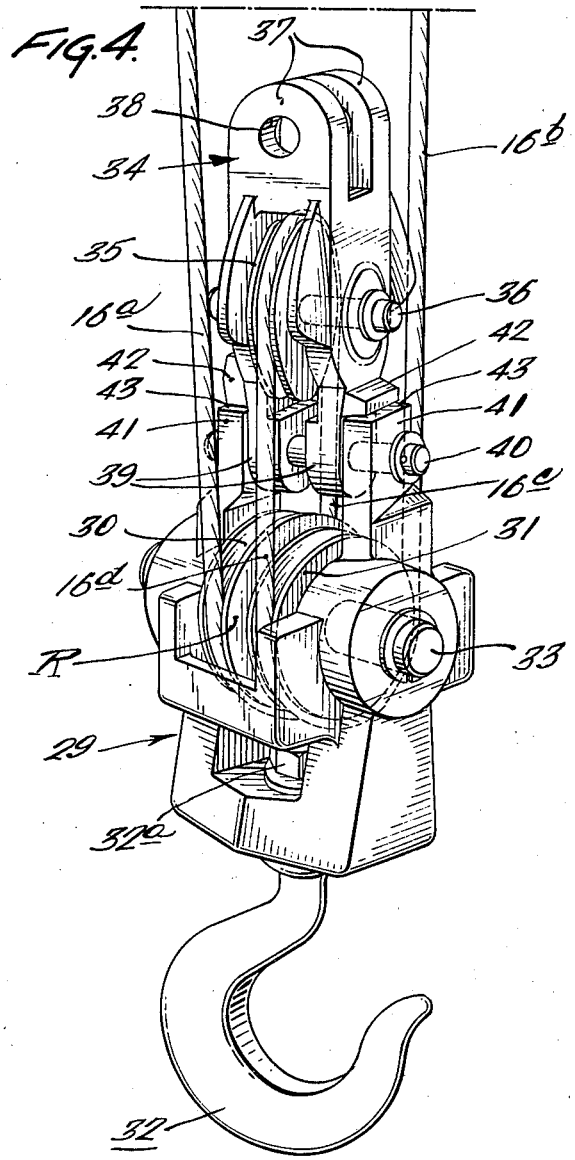
FIG. 4 is a perspective view, on a scale larger than that of the previous figures, showing the relation of the two pulley block assemblies, when the apparatus is adjusted for double rigging.

Under this double rigged condition, when the second pulley block assembly 34 is disposed in a lower position adjacent the first pulley block assembly 29, and is secured thereto by removable pin 40, (suitable pin securing means being used), the cable is so rigged as to pass from the drum downwardly through the guide loop 23 and serially around pulley 30 of block 29, upwardly around pulley 35 of block 34, (cable run 16*c* as seen in FIG. 4), thence downwardly (run 16*d*) into contact with pulley 31 of block 29, after which it returns upwardly, as shown by run 16*b*, and is secured by the member 18 to the main frame at 17.

Thus, even in the double rigged condition, there are, in addition to the runs 16*a* and 16*b*, two further cable runs. These are the upgoing run 16*c* (FIG. 4) and the downgoing run 16*d*. Under double rigging these latter two runs merely extend between pulley blocks 29 and 34, and since said pulley block 34 is fastened to the load-bearing block 29, rather than to the winch frame 11, the two additional runs of cable 16*c* and 16*d* have no effect on the mechanical advantage, which remains at a value of 2.

Figure 5:
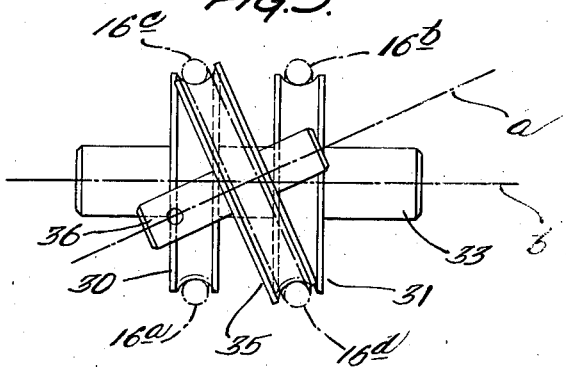
FIG. 5 is a schematic view, taken as indicated by line 5—5 of FIG. 3, showing the position which the pulley of the second, or upper, pulley block assembly has with respect to the pulleys of the lower, or first assembly, under the double rigged condition.

Two additional features of the apparatus, under double rigging, will now be described. As noted above, and as best seen in FIGS. 3 and 4, the arms 41,41 of pulley 29 are twisted so that the faces of said arms which confront and are secured in contact with corresponding faces of arms 39,39 do not lie in planes perpendicular to the axle 33, which supports pulleys 30 and 31. The amount of twist (about 25° in the illustrated embodiment) appears clearly in FIG. 5 which is a schematic representation of the upper pulley 35 and the lower pulleys 30 and 31. The view is taken as indicated by line 5—5 of FIG. 3, and shows at *a* and *b*, respectively, the angular disposition of the axis of rotation of pulley 35 on pin 36 as compared with that of pulleys 30 and 31 on pin 33. The twist of arms 41,41, and the resultant angular relation between axes *a* and *b*, optimizes alignment between the cable and the pulleys, and avoids excessive wear of both cable and pulleys, which would otherwise occur when the cable is required to transfer between pulleys in the short vertical distance afforded under double rigging.

It is also to be observed (see particularly FIG. 4) that projecting stop means 42, provided on the sides of pulley block 34, in the region of lower arms 39,39 cooperate with the end faces 43 of the arms 41 of pulley block 29, to ensure proper positioning of block 34 with respect to load-bearing block 29, to prevent fouling of the rigging. As illustrated in the drawings, this proper position of block 34 is the position in which it extends vertically upward from block 29.

Turning now to the quadruple rigging shown in FIGS. 1 and 2, it will be seen in what a simple manner the apparatus may be converted from the double to the quadruple condition. Under this latter condition, the above-described four runs of cable (16*a*, 16*b*, 16*c* and 16*d*) all still exist, and the conversion to quadruple rigging requires nothing more than transfer of the pulley block 34 back into adjacency with the winch 10, and securement of said block 34 to the frame 11. When so secured, all four lines of cable extend between the winch and the load. All are therefore effective in raising the load, and the mechanical advantage (ignoring friction losses) becomes 4.

The means by which block 34 is secured to the frame bears the general designation 19, and will now be described in detail. As noted earlier, the upper bifurcated end of block 34 defines arms 37,37, and these are cooperable with the pivot pin 25, which also supports the horizontal portion 23 (of member 23,24) which defines the guide loop. The arms 20 and 21, of the frame 11, are spaced sufficiently (see FIG. 2) to accommodate said arms 37,37, as well as arm 24 of the bell crank 23,24. When quadruple rigging is desired, it is a simple matter to remove the retaining pin 26, withdraw the pivot pin 25, and insert the two arms 37 of pulley-block assembly 34 in the space between the frame arms 20 and 21, straddling the bell crank 23,24, after which the pin 25 is inserted in the aligned apertures provided in the frame and pulley-block arms and, of course, in the bell crank. Re-insertion of the retaining pin 26 completes the operation, and the apparatus is ready for use under quadruple rigging. As will be understood, relocation of pulley-block assembly 34, to achieve either type of rigging, is effected only when the hoist apparatus is not under load. It may be noted that the retaining pin 26 and its snap ring 27 are shown, in detail, only in relation to pivot pin 25, but a similar type of fastening may be used in association with axle 36 and pin 40.

From the foregoing, it will be seen that the various pairs of arms 37,39, and 41 of the pulley-block assemblies, and lower extensions of the walls 20 and 21 of the frame 11, are all adapted for interleaving in various cooperative relationships, for very convenient alteration of rigging of the winch-hoist.

In fabricating apparatus in accordance with this invention, the main frame, lever, pulley blocks, and certain other parts have been cast of aluminum alloy. An example of such an alloy is that specified in the trade as number 356-T-6; but other suitable or equivalent materials may be used.

While the invention features the provision of a winch-hoist which is readily convertible from a double rigged condition to a condition which is a multiple thereof, with the advantages indicated above, utilization of the principles of my invention does not preclude the possibility of employing the apparatus under single rigging, or other multiples than those shown. Should single rigging be desired, the operator would remove the pulley-block assemblies 29 and 34 and substitute a load hook in place of the shackle 18 which is shown herein as connecting the cable to an upper portion of the frame 11, and such hook would cooperate directly with a load.

It will also be recognized that, while a stranded steel cable is preferably used with my new apparatus, the term "cable" is employed in a broad sense to refer to any flexible member or flexibly-jointed member suitable for the purposes of the invention.

The disclosure is intended as illustrative of the preferred practice of the invention, and is not to be limited except by the claims, as given the broadest construction consistent with differentiation from the prior art.

I claim:

1. In winch-hoist apparatus, a generally box-shaped winch frame having a top cross member, for securement to fixed structure, and a pair of arms extending from said cross member in spaced, general, parallelism toward a load, a drum mounted for rotation between said arms in an intermediate region of the length thereof, a cable having one portion secured to said drum, a spaced portion secured to said winch frame, and a looped, intermediate portion, means for rotating said drum to provide for reeling and unreeling of said cable from said drum, and load-carrying means carried in the cable loop and providing for use of the apparatus, selectively, under either a doubled rigging condition, or a rigging condition which is a multiple of such doubled rigging, said load-carrying means comprising: a first generally U-shaped pulley block assembly having hook means carried by the U, and at least first and second pulleys rotatably mounted between the arms of the U, which arms terminate in spaced, generally parallel, portions extending toward said winch frame; a second pulley block assembly, movably disposed in the cable rigging intermediate said winch frame and said first assembly, and carrying at least one pulley, said cable passing from said drum over the first pulley of said first assembly, then over said one pulley of said second assembly, then over the second pulley of said first assembly, and thence toward and into securement to said winch frame, said second assembly carrying securement means comprising pairs of spaced arms, one of said pairs facing said first assembly and the other of said pairs facing the spaced arms of said winch frame, said one pair of arms being shaped to interleave with the arm portions of said first assembly when double rigging is desired, said other pair being shaped to interleave with said winch frame arms when multiple rigging is desired; and means for selectively and releasably maintaining said one pair interleaved with the arm portions of said first pulley assembly, and means comprising pin means for selectively and releasably maintaining said other pair interleaved with the arms of said winch frame; and said apparatus further including adjustable means for guiding the cable with respect to said drum, during reeling and unreeling of the cable, said pin means including a portion which cooperates in providing adjustably pivotal securement of said guide means to said winch frame, under both the double and the multiple rigging conditions, the said guide means being Pivotally mounted on said pin means and located between the frame and said second assembly.

* * * * *